US011202518B1

(12) United States Patent
Lo

(10) Patent No.: US 11,202,518 B1
(45) Date of Patent: Dec. 21, 2021

(54) BABY CHAIR THAT IS ASSEMBLED AND DISASSEMBLED

(71) Applicant: Ten Square Inc, Deer Park, NY (US)

(72) Inventor: Feng-Jung Lo, Deer Park, NY (US)

(73) Assignee: Ten Square Inc., Deer Park, NY (US)

( * ) Notice: Subject to any disclaimer, the term of this patent is extended or adjusted under 35 U.S.C. 154(b) by 0 days.

(21) Appl. No.: 16/935,382

(22) Filed: Jul. 22, 2020

(51) Int. Cl.
*A47D 1/04* (2006.01)
*A47D 1/00* (2006.01)
*A47D 11/00* (2006.01)

(52) U.S. Cl.
CPC ..... *A47D 1/006* (2013.01); *A47D 1/0085* (2017.05); *A47D 1/04* (2013.01); *A47D 11/002* (2013.01)

(58) Field of Classification Search
CPC ..... A47D 1/006; A47D 1/0085; A47D 1/04; A47D 11/002
See application file for complete search history.

(56) References Cited

U.S. PATENT DOCUMENTS

2013/0099545 A1* 4/2013 Cheng ..... A47C 7/50 297/423.4
2018/0263379 A1* 9/2018 Cheng ..... A47D 1/006

FOREIGN PATENT DOCUMENTS

CN 111387755 A * 7/2020
CN 111938368 A * 11/2020
CN 213247977 U * 5/2021 ..... A47D 1/006
WO WO-2009034529 A2 * 3/2009 ..... A47C 7/002

* cited by examiner

*Primary Examiner* — Timothy J Brindley
(74) *Attorney, Agent, or Firm* — Karin L. Williams; Alan D. Kamrath; Mayer & Williams PC

(57) ABSTRACT

A baby chair includes a baby chair comprising a chair body and a support rack assembled with the chair body. The chair body includes a plurality of legs. The support rack includes a base and a plurality of fastening members. The base has a top provided with a plurality of positioning recesses. The fastening members are pivotally mounted in positioning recesses. The chair body is used individually to function as a baby chair, and the support rack is used individually to function as a baby table. When the support rack is assembled with the chair body, each of the legs of the chair body is inserted into each of the positioning recesses of the support rack, and is locked by each of the fastening members. Thus, the support rack increases the height of the chair body.

7 Claims, 11 Drawing Sheets

BABY CHAIR THAT IS ASSEMBLED AND DISASSEMBLED

BACKGROUND OF THE INVENTION

1. Field of the Invention

The present invention relates to a baby product and, more particularly, to a baby chair.

2. Description of the Related Art

Usually, when the baby is seated on the chair, the baby easily falls out of the chair due to the small volume. Thus, a baby dining chair is used for placing a baby steadily without the possibility of falling down. However, the conventional baby dining chair has a lower height such that the parent cannot feed and care the baby easily and conveniently, thereby greatly causing inconvenience to the parent when feeding and caring the baby.

BRIEF SUMMARY OF THE INVENTION

The primary objective of the present invention is to provide a baby chair that is assembled and disassembled and has an increased height.

In accordance with the present invention, there is provided a baby chair comprising a chair body and a support rack assembled with the chair body. The chair body includes a seat, a plurality of legs detachably mounted on a bottom of the seat, a stop column detachably mounted on the seat, a placement plate detachably mounted on the seat, and a backrest detachably mounted on the seat. Each of the legs has a lower end provided with a cavity and an abutment. The abutment is defined between the cavity and the lower end of each of the legs. The support rack includes a base, a plurality of support stands detachably mounted on a bottom of the base, and a plurality of fastening members mounted on the base. The base has a top provided with a plurality of positioning recesses, a plurality of ladder portions, and a plurality of receiving grooves. Each of the positioning recesses is connected to an outside of the base. Each of the ladder portions is located below and spaced from a bottom of each of the positioning recesses. Each of the receiving grooves is located below each of the ladder portions. Each of the receiving grooves is connected to the outside of the base. Each of the fastening members is provided with a pivot portion, a projection, a handle, and a neck portion. The pivot portion of each of the fastening members is pivotally mounted in each of the receiving grooves of the base. The projection and the handle are located at two sides of the pivot portion. The neck portion is formed on and protrudes from a top of the pivot portion. The neck portion is formed with a resting portion. A locking slot is formed in each of the fastening members and defined between the pivot portion and the resting portion. When the support rack is assembled with the chair body, each of the legs of the chair body is inserted into each of the positioning recesses of the support rack, the projection of each of the fastening members presses each of the ladder portions and is located below each of the legs of the chair body, the resting portion of each of the fastening members extends into the cavity of each of the legs, and the abutment of each of the legs is locked in the locking slot of each of the fastening members and pressed by the resting portion of each of the fastening members.

In assembly, each of the fastening members is driven upward to a position where the projection does not press each of the ladder portions. Then, each of the legs of the chair body is inserted into each of the positioning recesses of the base, and the projection of each of the fastening members is pressed by each of the legs of the chair body and is moved to press each of the ladder portions of the base. At the same time, the resting portion of each of the fastening members is moved and extend into the cavity of each of the legs, and presses the abutment of each of the legs, such that the abutment of each of the legs is pressed by the resting portion of each of the fastening members and locked in the locking slot of each of the fastening members. Thus, the support rack is assembled with the chair body.

According to the primary advantage of the present invention, the height of the chair body is increased by provision of the support rack.

According to another advantage of the present invention, when the chair body is mounted on the support rack, the height of the chair body is increased, to facilitate the user feeding or caring the baby, thereby providing a comfortable sensation to the user.

According to a further advantage of the present invention, the chair body is used individually to function as a baby chair, and the support rack is used individually to function as a baby table.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
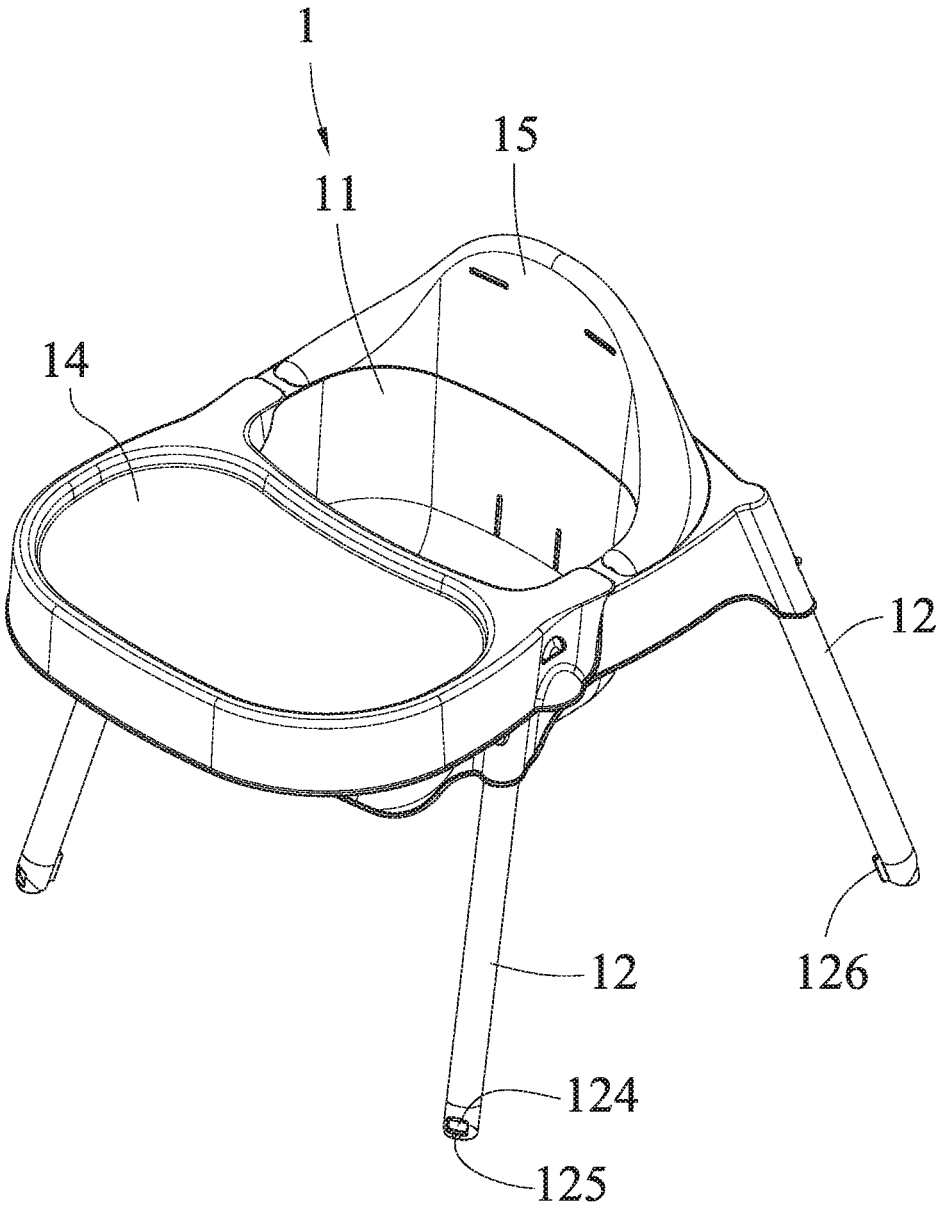
FIG. 1 is a perspective view of a chair body of a baby chair in accordance with the preferred embodiment of the present invention.
Figure 2:
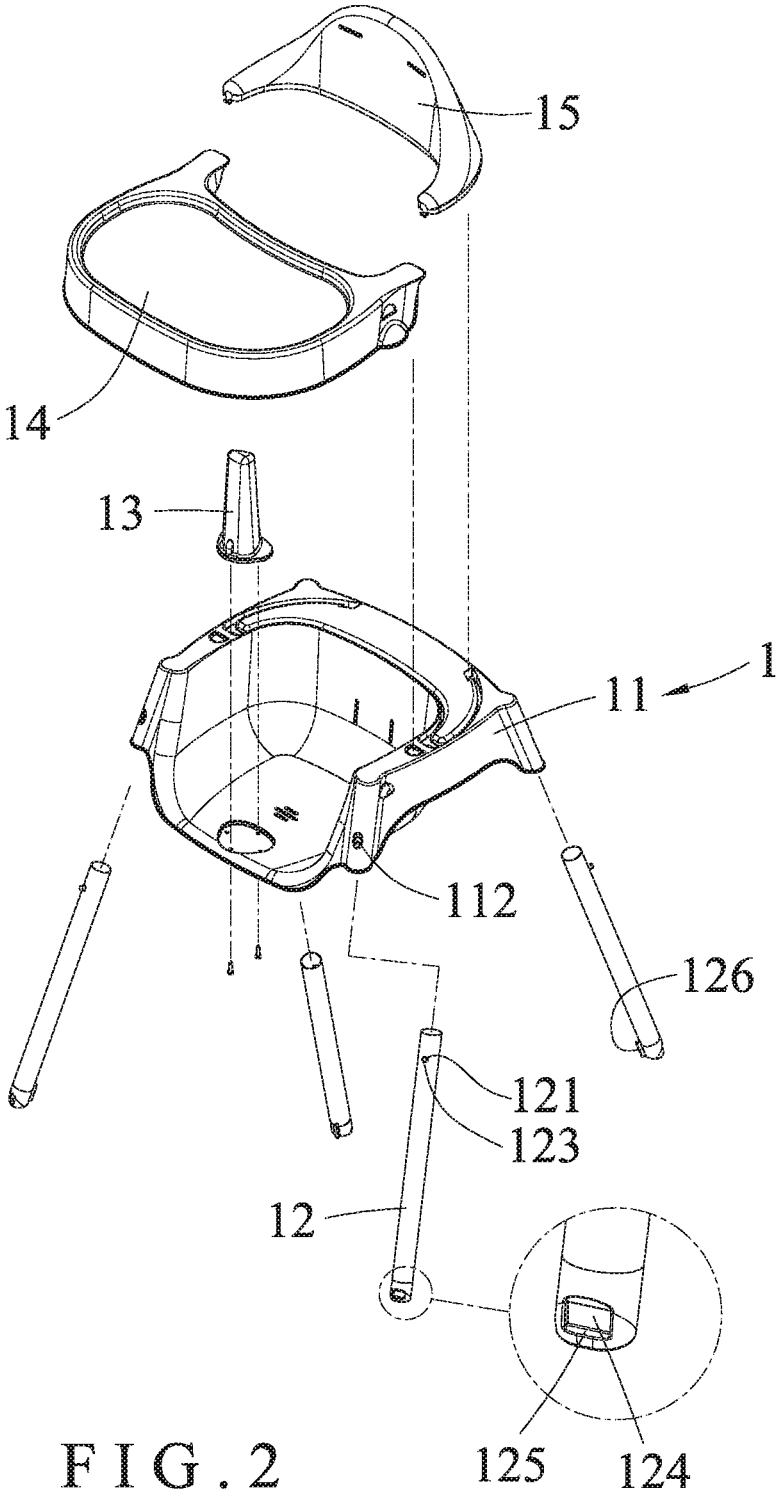
FIG. 2 is an exploded perspective view of the chair body as shown in FIG. 1.
Figure 3:
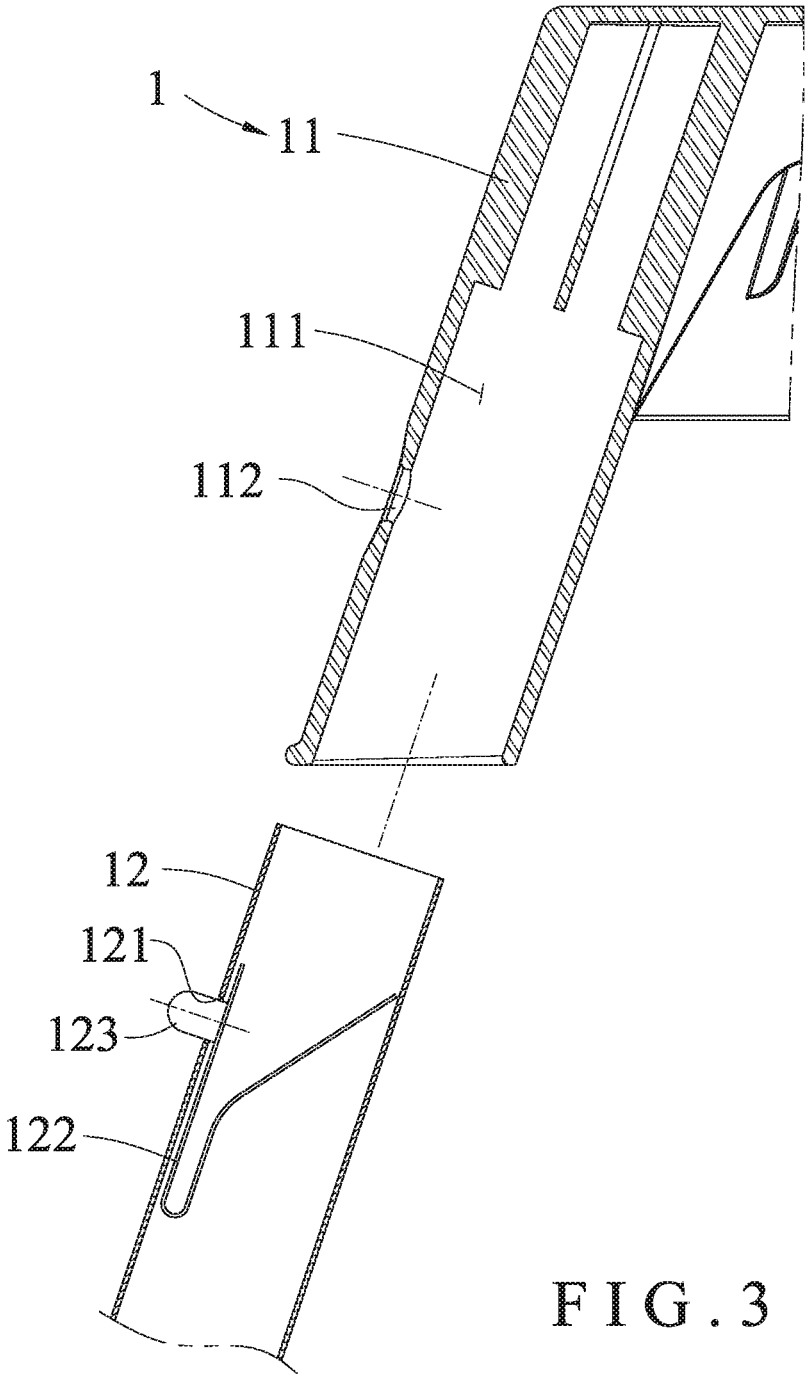
FIG. 3 is a partial cross-sectional view of the chair body in accordance with the preferred embodiment of the present invention.
Figure 4:
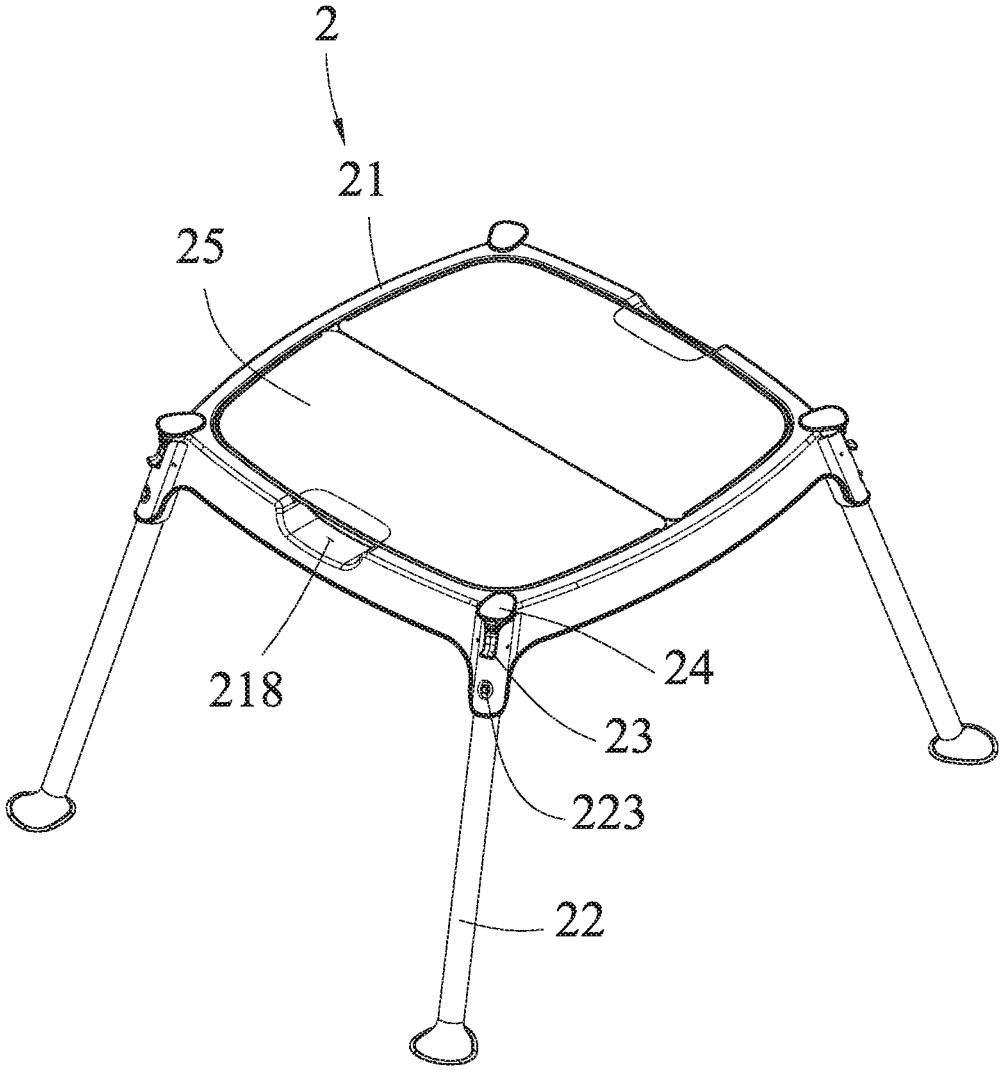
FIG. 4 is a perspective view of a support rack of the baby chair in accordance with the preferred embodiment of the present invention.
Figure 5:
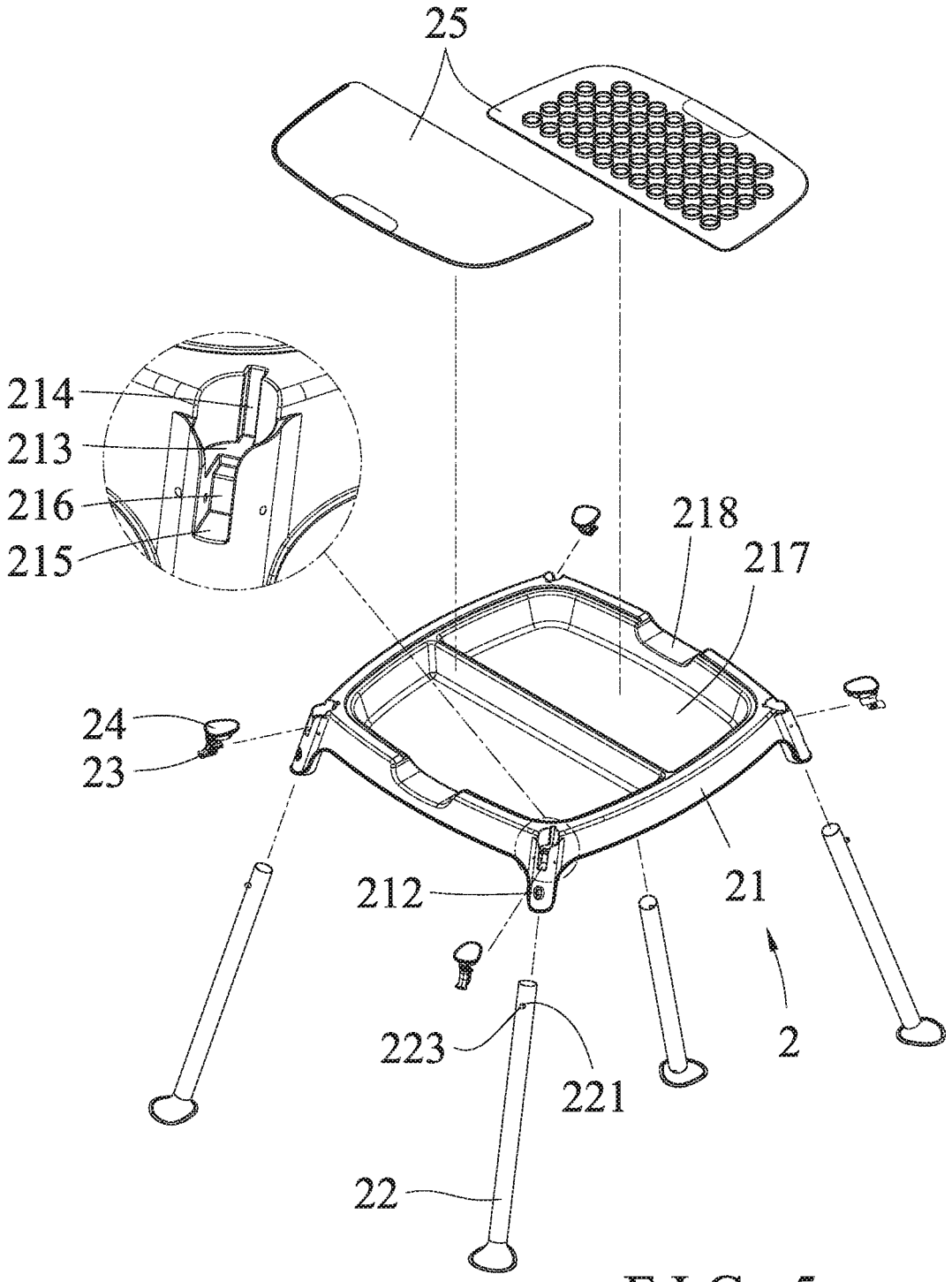
FIG. 5 is an exploded perspective view of the support rack as shown in FIG. 4.
Figure 6:
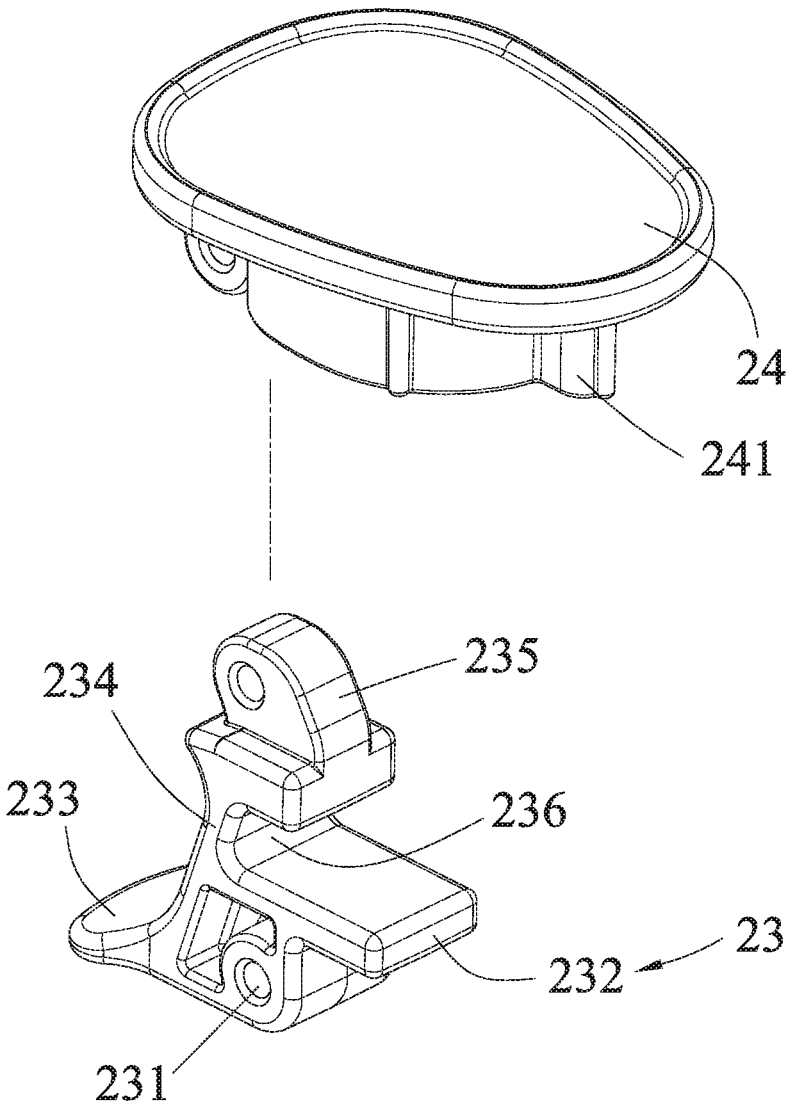
FIG. 6 is a locally enlarged exploded perspective view of the support rack as shown in FIG. 4.

Referring to the drawings and initially to FIGS. 1-7, a baby chair in accordance with the preferred embodiment of the present invention comprises a chair body 1 and a support rack (or frame) 2 combined (or assembled) with the chair body 1.

The chair body 1 includes a seat 11, a plurality of (preferably four) legs 12 detachably mounted on a bottom of the seat 11, a stop column 13 detachably mounted on the seat 11, a placement plate (or table or board or shelf) 14 detachably mounted on the seat 11, and a backrest 15 detachably mounted on the seat 11. Each of the legs 12 has a lower end provided with a cavity 124 and an abutment 125. The abutment 125 is defined between the cavity 124 and the lower end of each of the legs 12.

The support rack 2 includes a base 21, a plurality of (preferably four) support stands 22 detachably mounted on a bottom of the base 21, and a plurality of (preferably four) fastening members (or fasteners) 23 mounted on the base 21.

The base 21 has a top provided with a plurality of (preferably four) positioning recesses 213, a plurality of (preferably four) ladder (or stepped) portions 216, and a plurality of (preferably four) receiving grooves 215. Each of the positioning recesses 213 is connected to an outside of the base 21. Each of the ladder portions 216 is located below and spaced from a bottom of each of the positioning recesses 213. Each of the ladder portions 216 is located at a side of each of the receiving grooves 215. Each of the receiving grooves 215 is located below each of the ladder portions 216. Each of the receiving grooves 215 is connected to the outside of the base 21.

Figure 7:
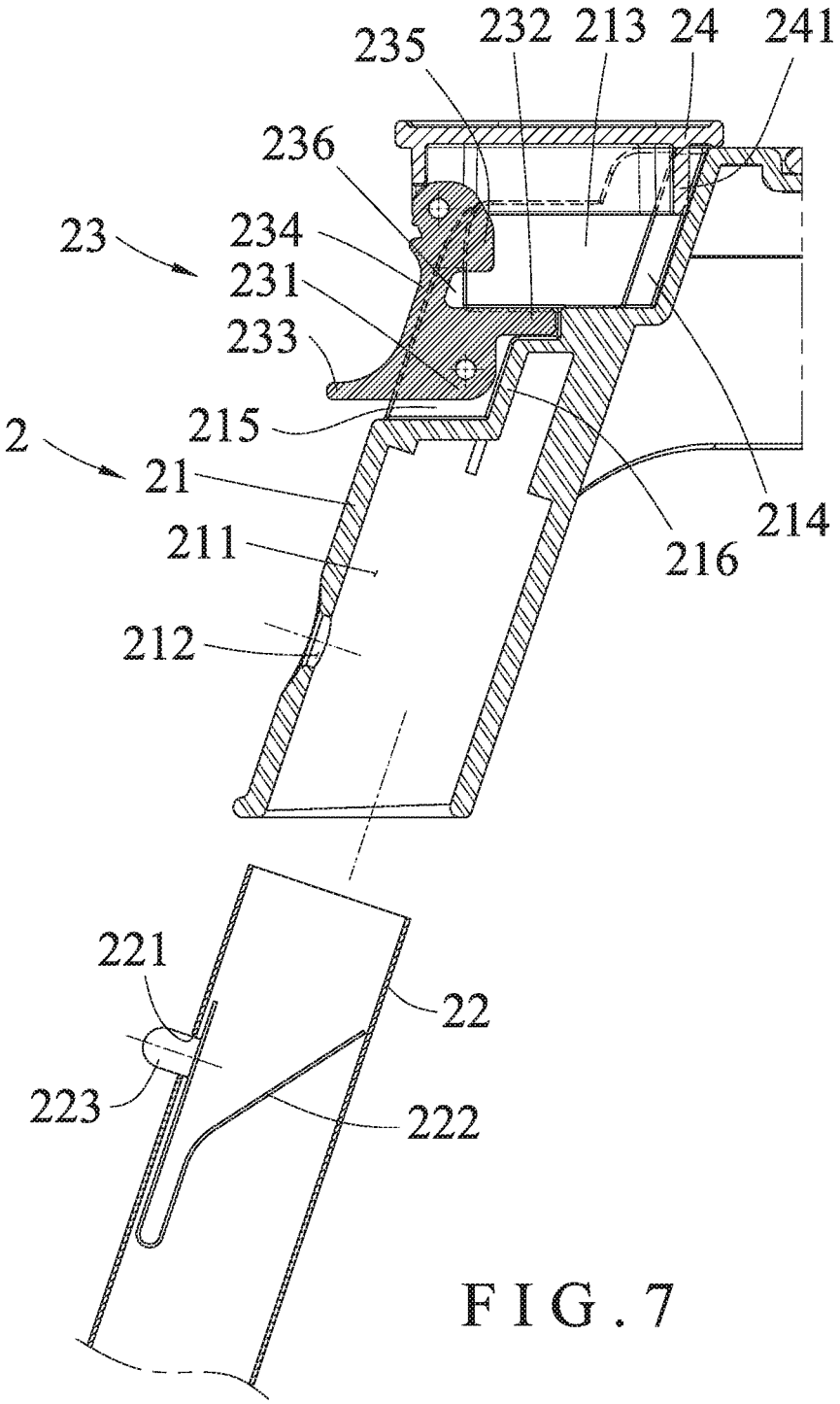
FIG. 7 is a partial exploded cross-sectional view of the support rack in accordance with the preferred embodiment of the present invention.

Each of the fastening members 23 is provided with a pivot portion 231, a projection 232, a handle 233, and a neck portion 234. The pivot portion 231 of each of the fastening members 23 is pivotally mounted in each of the receiving grooves 215 of the base 21. Thus, each of the fastening members 23 is driven and pivoted such that the projection 232 presses each of the ladder portions 216 as shown in FIG. 7. The projection 232 and the handle 233 are located at two sides of the pivot portion 231. The neck portion 234 is formed on and protrudes from a top of the pivot portion 231. The neck portion 234 is formed with a resting (or pressing or locking) portion 235. A locking slot 236 is formed in each of the fastening members 23 and defined between the pivot portion 231 and the resting portion 235.

When the support rack 2 is assembled with the chair body 1, each of the legs 12 of the chair body 1 is inserted into each of the positioning recesses 213 of the support rack 2, the projection 232 of each of the fastening members 23 presses each of the ladder portions 216 and is located below each of the legs 12 of the chair body 1, the resting portion 235 of each of the fastening members 23 extends into the cavity 124 of each of the legs 12, and the abutment 125 of each of the legs 12 is locked in the locking slot 236 of each of the fastening members 23 and pressed by the resting portion 235 of each of the fastening members 23.

In the preferred embodiment of the present invention, the bottom of the seat 11 of the chair body 1 is provided with a plurality of (preferably four) seat slots 111. Each of the seat slots 111 is provided with a seat opening 112 connected to an outside thereof. Each of the legs 12 is hollow and has an upper end provided with a leg opening 121. Each of the legs 12 has an interior provided with a leg spring 122. The leg spring 122 of each of the legs 12 is provided with a leg knob 123 extending through and protruding from the leg opening 121. When each of the legs 12 is inserted into each of the seat slots 111 of the seat 11, the leg knob 123 of each of the legs 12 is locked in the seat opening 112 of each of the seat slots 111 of the seat 11 to secure each of the legs 12.

In the preferred embodiment of the present invention, the base 21 of the support rack 2 is provided with a plurality of (preferably four) insert channels 214 connected to and located at a side of the positioning recesses 213 respectively. The lower end of each of the legs 12 of the chair body 1 is provided with a leg insert 126. The leg insert 126 of each of the legs 12 is inserted into each of the insert channels 214 of the base 21.

In the preferred embodiment of the present invention, the bottom of the base 21 of the support rack 2 is provided with a plurality of (preferably four) base slots 211. Each of the base slots 211 is provided with a base opening 212 connected to an outside thereof. Each of the support stands 22 is hollow and has an upper end provided with a stand opening 221. Each of the support stands 22 has an interior provided with a stand spring 222. The stand spring 222 of each of the support stands 22 is provided with a stand knob 223 extending through and protruding from the stand opening 221. When each of the support stands 22 is inserted into each of the base slots 211 of the base 21, the stand knob 223 of each of the support stands 22 is locked in the base opening 212 of each of the base slots 211 of the base 21 to secure each of the support stands 22.

In the preferred embodiment of the present invention, each of the positioning recesses 213 of the support rack 2 is located above each of the base slots 211.

In the preferred embodiment of the present invention, the top of the base 21 is provided with at least one placement chamber 217 and at least one side breach 218. The at least one side breach 218 is connected to the at least one placement chamber 217. The support rack 2 further includes at least one table mat 25 placed in the at least one placement chamber 217. Preferably, the base 21 has two placement chambers 217 and two side breaches 218, and the support rack 2 includes two table mats 25.

In the preferred embodiment of the present invention, the support rack 2 further includes a plurality of (preferably four) covers 24 mounted on the fastening members 23 respectively. Each of the covers 24 is pivotally mounted on the resting portion 235 of each of the fastening members 23. Each of the covers 24 cover each of the positioning recesses 213 of the base 21 when the support rack 2 is detached from the chair body 1. Each of the covers 24 has a bottom formed with a cover insert 241.

In practice, again referring to FIGS. 1-7, the chair body 1 is used individually. At this time, the baby is seated on the seat 11, while the placement plate 14 is used to place an article, such as a bowl, a dish or the like.

Figure 8:
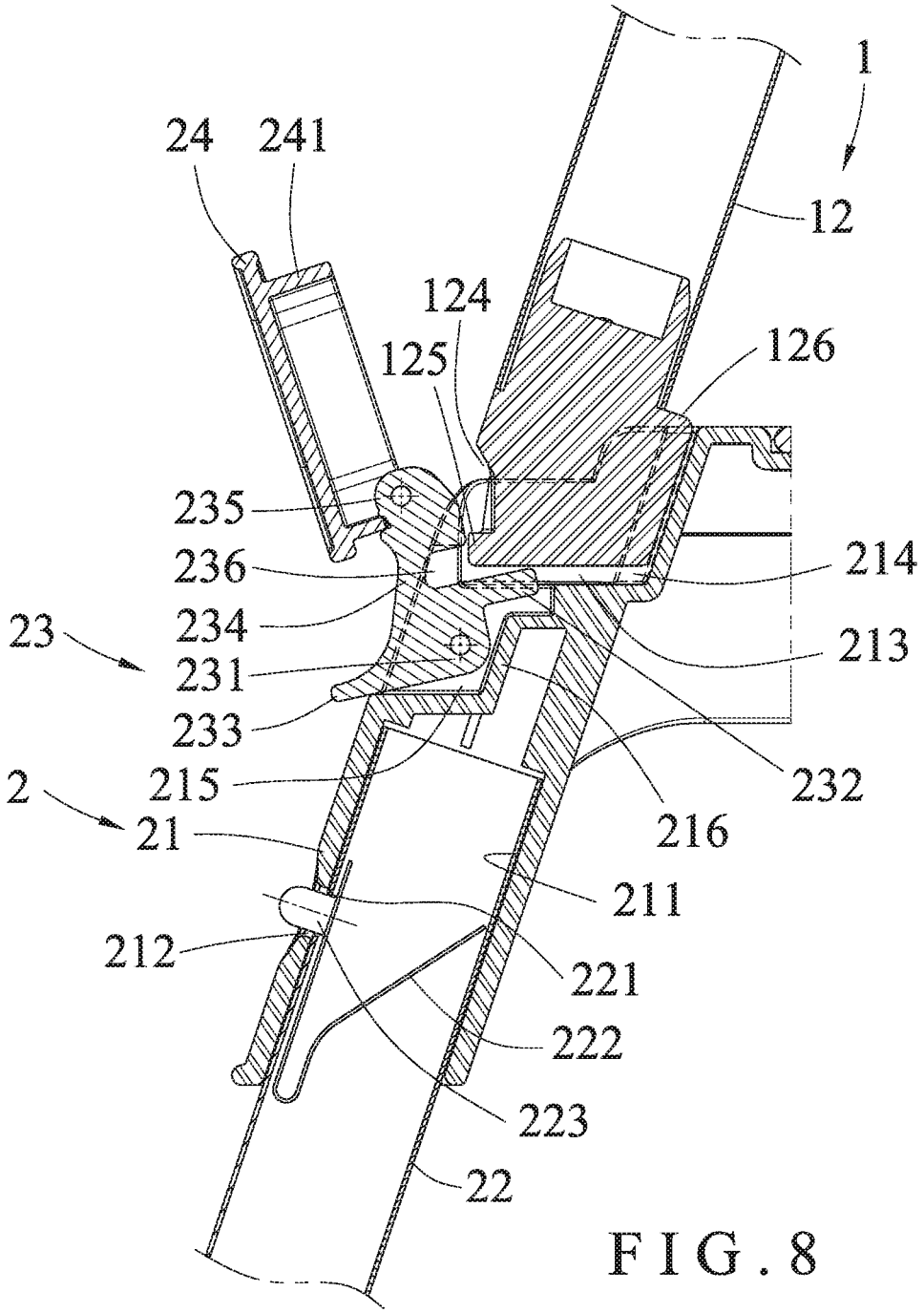
FIG. 8 is a partial cross-sectional view showing partial assembly of the chair body and the support rack.
Figure 9:
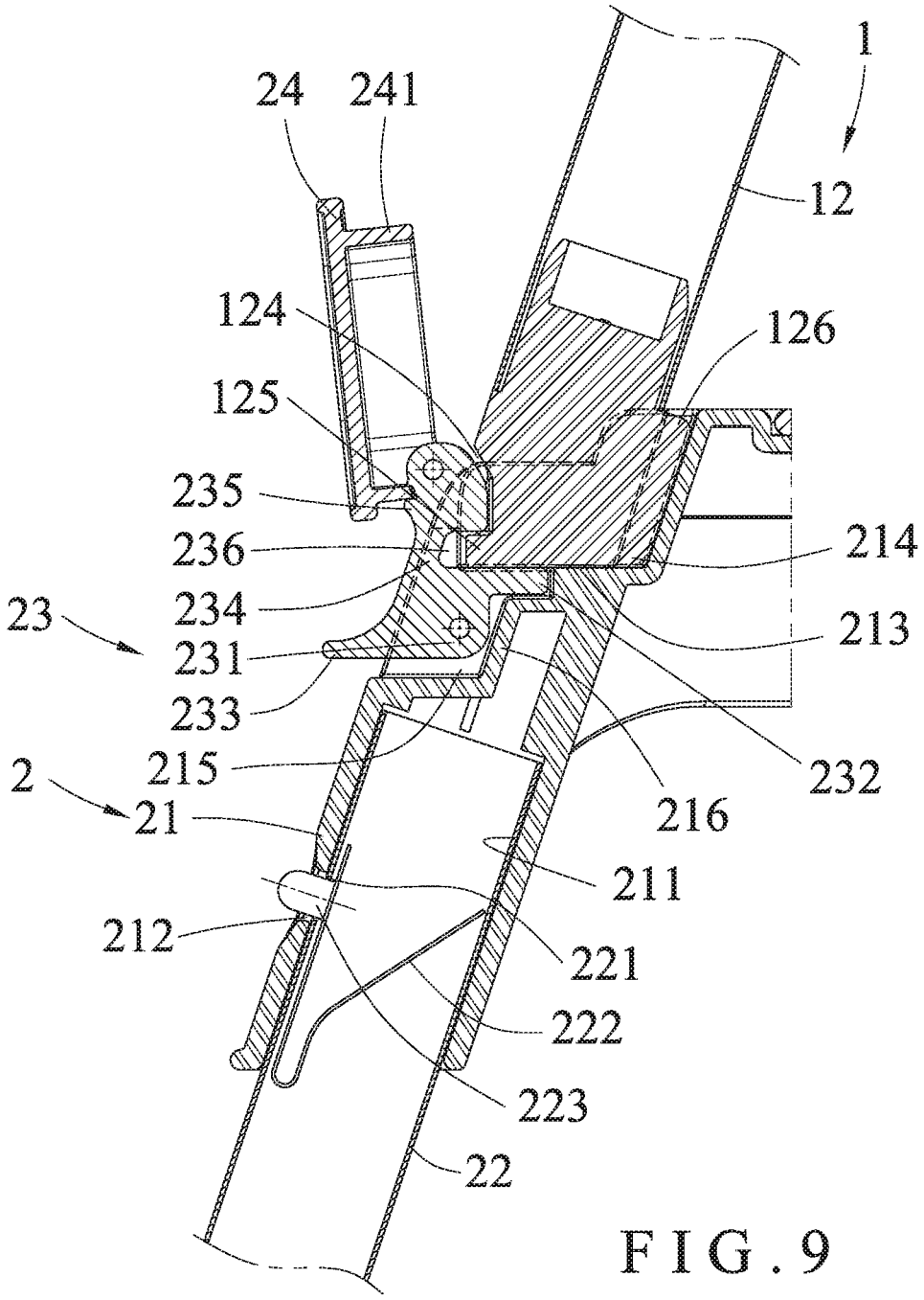
FIG. 9 is a partial cross-sectional view showing assembly of the chair body and the support rack.
Figure 10:
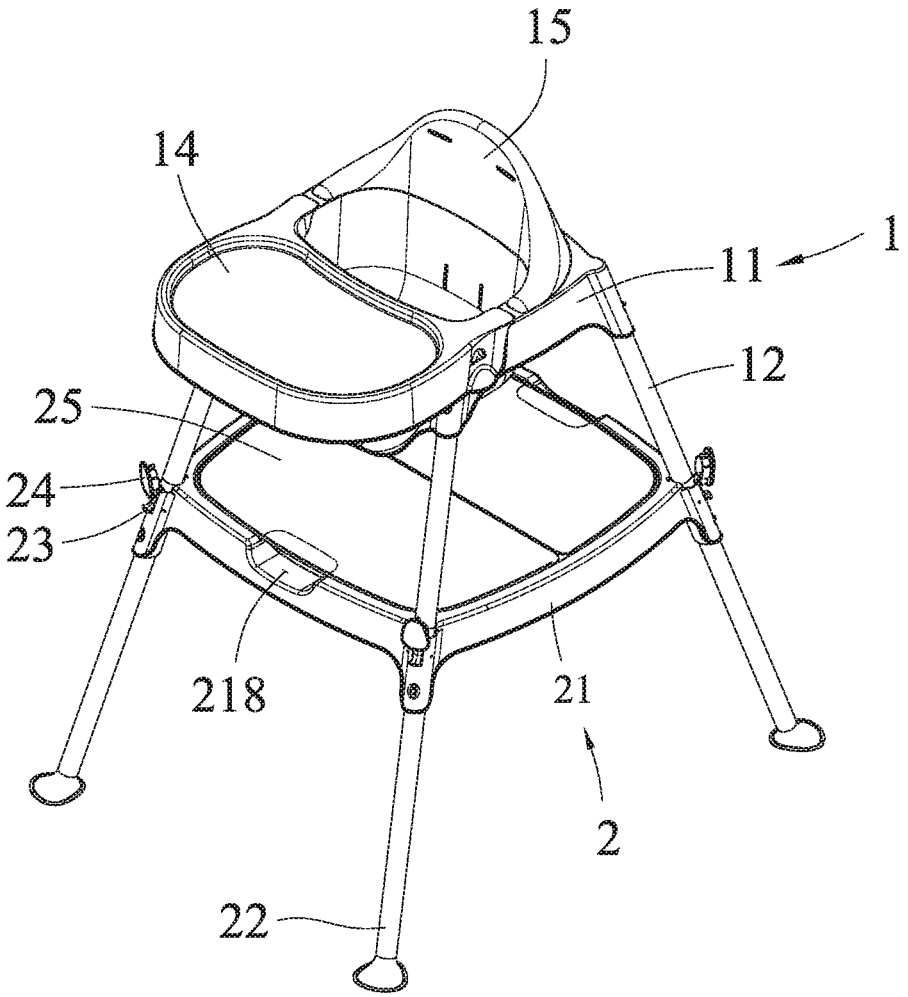
FIG. 10 is a perspective view of the baby chair in accordance with the preferred embodiment of the present invention.

Referring now to FIGS. 8-10 with reference to FIGS. 1-7, when the user wishes to assemble the support rack 2 with the chair body 1, each of the fastening members 23 is driven and pivoted upward to a position where the projection 232 is detached from and does not press each of the ladder portions 216 as shown in FIG. 8. In such a manner, when each of the legs 12 of the chair body 1 is inserted into each of the positioning recesses 213 of the support rack 2, the resting portion 235 of each of the fastening members 23 will not obstruct each of the legs 12 of the chair body 1. At the same time, the projection 232 of each of the fastening members 23 is still located below each of the legs 12 of the chair body 1. Then, each of the legs 12 of the chair body 1 is inserted into and reaches the bottom of each of the positioning recesses 213 of the base 21, and the leg insert 126 of each of the legs 12 is inserted into each of the insert channels 214 of the base 21. In such a manner, the projection 232 of each of the fastening members 23 is pressed by each of the legs 12 of the chair body 1 and is moved to press each of the ladder portions 216 of the base 21. At the same time, the resting portion 235 of each of the fastening members 23 is moved and extend into the cavity 124 of each of the legs 12, and presses the abutment 125 of each of the legs 12, such that the abutment 125 of each of the legs 12 is pressed by the resting portion 235 of each of the fastening members 23 and locked in the locking slot 236 of each of the fastening members 23 as shown in FIG. 9. The user may drive the handle 233 of each of the fastening members 23 upward to assure that each of the legs 12 is locked by each of the fastening members 23. Thus, the chair body 1 is mounted on and combined with the support rack 2 as shown in FIG. 10 to increase the height thereof, thereby facilitating the user feeding or caring the baby.

When the user wishes to detach the chair body 1 from the support rack 2, the handle 233 of each of the fastening members 23 is forcibly driven downward, to drive the projection 232 of each of the fastening members 23 to push each of the legs 12 upward, such that the abutment 125 of each of the legs 12 is unlocked and released from the locking slot 236 of each of the fastening members 23. Thus, each of the legs 12 of the chair body 1 is pulled upward and detached from each of the positioning recesses 213 of the base 21, such that the chair body 1 is detached from the support rack 2.

Figure 11:
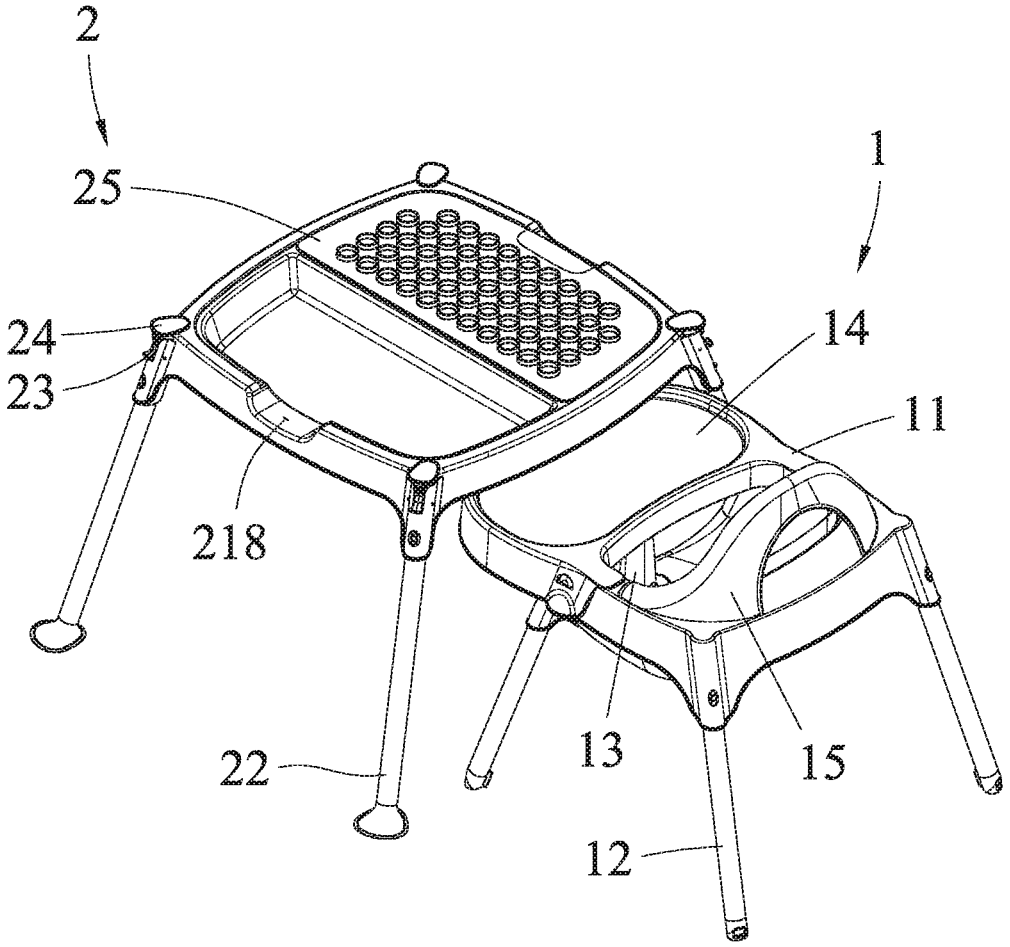
FIG. 11 is a perspective view showing the chair body and the support rack are separated and used individually.

As shown in FIG. 11, after the chair body 1 is separated from the support rack 2, the support rack 2 is used individually to function as a dining table. At this time, each of the fastening members 23 is driven upward, and each of the covers 24 is pressed downward to cover each of the positioning recesses 213 of the base 21 as shown in FIG. 7. At this time, the cover insert 241 of each of the covers 24 is inserted into each of the insert channels 214 of the base 21.

In the preferred embodiment of the present invention, the base 21 and the fastening members 23 are made of hard plastic material with a slight elastically deforming capacity, such that when each of the legs 12 of the chair body 1 is inserted into each of the positioning recesses 213 of the support rack 2, each of the fastening members 23 is kept at the position as shown in FIG. 8. In addition, each of the fastening members 23 has a width slightly more than that of each of the receiving grooves 215 of the base 21, such that each of the fastening members 23 is slightly pressed by each of the receiving grooves 215 of the base 21, and is kept at the position as shown in FIG. 8.

Accordingly, the height of the chair body 1 is increased by provision of the support rack 2. In addition, when the chair body 1 is mounted on the support rack 2, the height of the chair body 1 is increased, to facilitate the user feeding or caring the baby, thereby providing a comfortable sensation to the user. Further, the chair body 1 is used individually to function as a baby chair, and the support rack 2 is used individually to function as a baby table.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the scope of the invention.

The invention claimed is:

1. A baby chair comprising:

a chair body; and a support rack assembled with the chair body;

wherein:

the chair body includes a seat, a plurality of legs detachably mounted on a bottom of the seat, a stop column detachably mounted on the seat, a placement plate detachably mounted on the seat, and a backrest detachably mounted on the seat;

each of the legs has a lower end provided with a cavity and an abutment;

the abutment is defined between the cavity and the lower end of each of the legs;

the support rack includes a base, a plurality of support stands detachably mounted on a bottom of the base, and a plurality of fastening members mounted on the base;

the base has a top provided with a plurality of positioning recesses, a plurality of ladder portions, and a plurality of receiving grooves;

each of the positioning recesses is connected to an outside of the base;

each of the ladder portions is located below and spaced from a bottom of each of the positioning recesses;

each of the receiving grooves is located below each of the ladder portions;

each of the receiving grooves is connected to the outside of the base;

each of the fastening members is provided with a pivot portion, a projection, a handle, and a neck portion;

the pivot portion of each of the fastening members is pivotally mounted in each of the receiving grooves of the base;

the projection and the handle are located at two sides of the pivot portion;

the neck portion is formed on and protrudes from a top of the pivot portion;

the neck portion is formed with a resting portion;

a locking slot is formed in each of the fastening members and defined between the pivot portion and the resting portion; and when the support rack is assembled with the chair body, each of the legs of the chair body is inserted into each of the positioning recesses of the support rack, the projection of each of the fastening members presses each of the ladder portions and is located below each of the legs of the chair body, the resting portion of each of the fastening members extends into the cavity of each of the legs, and the abutment of each of the legs is locked in the locking slot of each of the fastening members and pressed by the resting portion of each of the fastening members.

2. The baby chair as claimed in claim 1, wherein:

the bottom of the seat of the chair body is provided with a plurality of seat slots;

each of the seat slots is provided with a seat opening;

each of the legs is hollow and has an upper end provided with a leg opening;

each of the legs has an interior provided with a leg spring;

the leg spring of each of the legs is provided with a leg knob extending through the leg opening; and when each of the legs is inserted into each of the seat slots of the seat, the leg knob of each of the legs is locked in the seat opening of each of the seat slots of the seat.

3. The baby chair as claimed in claim 1, wherein:

the base of the support rack is provided with a plurality of insert channels connected to and located at a side of the positioning recesses respectively;

the lower end of each of the legs of the chair body is provided with a leg insert; and the leg insert of each of the legs is inserted into each of the insert channels of the base.

4. The baby chair as claimed in claim 1, wherein:

the bottom of the base of the support rack is provided with a plurality of base slots;

each of the base slots is provided with a base opening;

each of the support stands is hollow and has an upper end provided with a stand opening;

each of the support stands has an interior provided with a stand spring;

the stand spring of each of the support stands is provided with a stand knob extending through the stand opening; and when each of the support stands is inserted into each of the base slots of the base, the stand knob of each of the support stands is locked in the base opening of each of the base slots of the base.

5. The baby chair as claimed in claim 4, wherein each of the positioning recesses of the support rack is located above each of the base slots.

6. The baby chair as claimed in claim 1, wherein:

the top of the base is provided with at least one placement chamber and at least one side breach;

the at least one side breach is connected to the at least one placement chamber; and the support rack further includes at least one table mat placed in the at least one placement chamber.

7. The baby chair as claimed in claim 1, wherein:

the support rack further includes a plurality of covers mounted on the fastening members respectively;

each of the covers is pivotally mounted on the resting portion of each of the fastening members; and each of the covers cover each of the positioning recesses of the base when the support rack is detached from the chair body.

* * * * *